US010889398B2

(12) United States Patent
Sermenghi et al.

(10) Patent No.: US 10,889,398 B2
(45) Date of Patent: Jan. 12, 2021

(54) DEVICE AND MACHINE FOR MAKING FILTER BAGS OF TETRAHEDRAL SHAPE

(71) Applicant: I.M.A. INDUSTRIA MACCHINE AUTOMATICHE S.P.A., Ozzano Dell'Emilia (IT)

(72) Inventors: Andrea Sermenghi, Toscanella di Dozza (IT); Sauro Rivola, Riolo Terme (IT)

(73) Assignee: I.M.A. INDUSTRIA MACCHINE AUTOMATICHE S.P.A., Ozzano Dell'Emilia (IT)

( * ) Notice: Subject to any disclaimer, the term of this patent is extended or adjusted under 35 U.S.C. 154(b) by 187 days.

(21) Appl. No.: 16/095,248

(22) PCT Filed: May 9, 2017

(86) PCT No.: PCT/IB2017/052686
§ 371 (c)(1),
(2) Date: Oct. 19, 2018

(87) PCT Pub. No.: WO2017/195102
PCT Pub. Date: Nov. 16, 2017

(65) Prior Publication Data

US 2019/0144152 A1 May 16, 2019

(30) Foreign Application Priority Data

May 11, 2016 (IT) ..... 102016000048400

(51) Int. Cl.
*B65B 29/02* (2006.01)
*B65D 75/50* (2006.01)
(Continued)

(52) U.S. Cl.
CPC ..... *B65B 29/028* (2017.08); *B65B 9/2056* (2013.01); *B65B 51/303* (2013.01); *B65D 75/50* (2013.01)

(58) Field of Classification Search
CPC ..... B31B 70/28; B31B 70/30; B31B 2100/00; B31B 2110/20; B31B 2110/30;
(Continued)

(56) References Cited

U.S. PATENT DOCUMENTS 2,741,079 A * 4/1956 Rausing ..... B65B 9/207 53/551
3,482,373 A * 12/1969 Morris ..... B65B 9/213 53/511
(Continued)

FOREIGN PATENT DOCUMENTS

CH 463364 A 9/1968
CN 1152283 A 6/1997
(Continued)

OTHER PUBLICATIONS

Chinese Office Action dated Jan. 6, 2020 for counterpart Japenese Patent Application No. 201780029250.X.
(Continued)

*Primary Examiner* — Hemant Desai
*Assistant Examiner* — Christopher Robin Kim
(74) *Attorney, Agent, or Firm* — Shuttleworth & Ingersoll, PLC; Timothy J. Klima

(57) ABSTRACT

A forming tube for making filter bags of tetrahedral shape for infusion products including a forming element, which is elongate and hollow, which defines a longitudinal axis and which has a first opening through which the product enters in the forming element, a second opening through which the product leaves from the forming element to be dosed inside a filter bag being formed, and an inner through cavity which
(Continued)

connects the first opening to the second opening and inside of which flows the infusion product. The forming element includes a main body substantially tubular including the first opening and a forming end including the second opening and mobile in rotation with respect to the main body about the longitudinal axis.

12 Claims, 4 Drawing Sheets

(51) Int. Cl.
*B65B 51/30* (2006.01)
*B65B 9/20* (2012.01)

(58) Field of Classification Search
CPC ..... B31B 2110/35; B31B 2155/001; B65D 75/50; B65B 29/00; B65B 29/02; B65B 29/028; B65B 9/22; B65B 9/2056; B65B 9/2049; B65B 9/2042; B65B 1/04; B65B 1/06; B65B 1/24; B65B 37/06; B65B 51/26; B65B 51/30; B65B 51/303
USPC ..... 53/551
See application file for complete search history.

(56) References Cited

U.S. PATENT DOCUMENTS 3,734,388 A * 5/1973 Hopkins ..... B65D 75/5855 383/210
4,421,499 A * 12/1983 Kuipers ..... B65B 9/2035 156/203
5,255,497 A * 10/1993 Zoromski ..... B65B 9/2021 53/551
5,548,947 A * 8/1996 Fincham ..... B65B 29/028 53/551
6,041,980 A * 3/2000 Goodwin ..... B65B 1/36 222/504
10,450,097 B2 * 10/2019 Rivola ..... B65B 1/36
2005/0166359 A1 * 8/2005 Wertz ..... A47L 5/36 15/327.5
2015/0140179 A1 * 5/2015 Askew ..... B65B 61/04 426/77
2020/0087009 A1 * 3/2020 Tsuruta ..... B65B 9/213

FOREIGN PATENT DOCUMENTS

CN 102858637 A 1/2013
CN 103402875 A 11/2013
CN 105383745 A 3/2016
EP 800993 A1 10/1997
GB 2335175 A 9/1999
JP 2012020780 A 2/2012
WO WO9501907 A2 1/1995
WO WO2010007691 A1 1/2010
WO WO2010140242 A1 12/2010

OTHER PUBLICATIONS

International Search Report and Written Opinion dated Jul. 27, 2017 for counterpart PCT Application No. PCT/IB2017/052686.

* cited by examiner

DEVICE AND MACHINE FOR MAKING FILTER BAGS OF TETRAHEDRAL SHAPE

This application is the National Phase of International Application PCT/IB2017/052686 filed May 9, 2017 which designated the U.S.

This application claims priority to Italian Patent Application No. 102016000048400 filed May 11, 2016, which application is incorporated by reference herein.

TECHNICAL FIELD

This invention relates to a device and a machine for making filter bags for infusion or extraction products (such as tea, coffee, camomile, etc.). More specifically, this invention relates to a device and a machine for making filter bags for infusion or extraction products of tetrahedral shape.

BACKGROUND ART

There are prior art machines for making filter bags of tetrahedral shape. An example of these machines is known from patent document EP 800993, which shows a machine with operating stations located along a vertical direction of extension.

The machine comprises a feed station which feeds a continuous strip of filter material and a forming and joining station, which form and joins the continuous strip of filter material in a tubular shape.

The forming and joining station comprises a hollow tubular element, positioned vertically, about which is wound the continuous strip of filter material (by a series of suitable folding walls) feeding along a vertical feed direction.

The continuous strip of filter material in the tubular shape has two superposed free longitudinal flaps, which are joined along the vertical feed axis by a sealing device located close to the hollow tubular element, in such a way as to obtain a continuous longitudinal seal on the continuous strip of filter material in the tubular shape.

Above the hollow tubular element there is a dosing station configured for introducing an infusion product inside the hollow tubular element.

The machine comprises, immediately below a lower end of the hollow tubular element, a transversal sealing station for making transversal seals on the continuous strip of filter material in the tubular shape.

To obtain a filter bag of tetrahedral shape, two separate transversal seals are necessary, spaced part from each other along the continuous strip of filter material in the tubular shape, and differently oriented at a right angle to each other.

In the machine illustrated in patent document EP 800993, the transversal sealing station for comprises two pairs of rotors equipped with radial arms which have sealing elements and which rotate about respective axes of rotation which lie on a common plane, the blades of each pair of rotors rotating about respective parallel axes of rotation in opposite directions, to move the sealing elements towards each other, engage the continuous strip of filter material in a tubular shape, and form the transversal seals.

The pairs of rotors are configured to alternate with each other in the sealing step, in a synchronised fashion with the lowering of the continuous strip of filter material in a tubular shape.

A first pair of rotors performs a first transversal seal to define a bottom of the filter bag, and to allow, in a subsequent step, the falling of a dose of product along the hollow tubular element, and a second pair of rotors performs a second transversal seal for closing the filter bag, rotated by 90° relative to the first seal.

To guarantee that the filter material on which the transversal seals are made does not have creases which would worsen the quality of the transversal seals, the machine comprises a tensioning device positioned at the lower end of the hollow tubular element.

More in detail, the tensioning device comprises four tensioning arms, protruding downwards from the lower end of the hollow tubular element, towards the sealing units. More specifically, each of the four tensioning arms has a first end articulated to the bottom end of the hollow tubular element and a second free end.

Each tensioning arm can rotate about a respective axis of articulation between a first operating position inclined towards the inside of the hollow tubular element, wherein the second end is moved close to an axis of longitudinal extension of the hollow tubular element, and a second operating position inclined towards the outside of the hollow tubular element, wherein the second end is moved away from the axis of longitudinal extension of the hollow tubular element.

In use, a first pair of tensioning arms facing each other open to move to the second operating position, whilst a second pair of tensioning arms facing each other close to move to the first operating position, to tension a portion of filter material on which the sealing elements of a first pair of rotors make a first transversal seal. Subsequently, the second pair of tensioning arms facing each other open to move to the second operating position, whilst the first pair of tensioning arms facing each other close to move to the first operating position to tension a further portion of filter material on which the sealing elements of a second pair of rotors make a second transversal seal, rotated by 90° relative to the first transversal seal.

The tensioning device described above has drawbacks. Firstly, it has a complex structure, since kinematic mechanisms are necessary for operating in a synchronised fashion the individual tensioning arms and, consequently, the tubular element must be equipped with an outer jacket in which to house the kinematic mechanisms and related linkage devices useful for transmitting the motion to each single tensioning arm, with increases in dimensions.

Moreover, the tensioning arms have a limited outer surface which may cause an incorrect tensioning of the continuous strip of filter material, or cause tears of the filter material.

A further example of a machine for making filter bags of tetrahedral shape is known from patent document WO 2010/140242, which illustrates a machine comprising operating stations similar to the operating stations of the machine described in patent document EP 800993, but a different tensioning device.

More in detail, the tensioning device illustrated in patent document WO 2010/140242 comprises an elastically compliant tubular cylinder (for example rubber) associated with a tubular element. The tubular cylinder protrudes downwardly from the tubular element, towards the sealing unit.

The tubular cylinder defines a flexible core for the portion of filter material subjected to the transversal seal, so that the tubular cylinder may be flattened under the action of a pair of opposite sealing devices, according to mutually and alternately transversal directions.

A further tensioning device of the above-mentioned type is illustrated in patent document JP 2012 020780. This document illustrates a tubular cylinder which is flexible thanks to the longitudinal grooves along the free edges to yield elastically when the portions of filter material are subjected to the transversal sealing.

The tensioning device illustrated in WO 2010/140242 and JP 2012 020780 has drawbacks.

In effect, over time, the repeated flattening caused by the sealers may adversely affect the deformability features of the tubular cylinder, to the point of adversely affecting the correct operation of the machine, with the consequence that the tubular cylinder must be often replaced.

DISCLOSURE OF THE INVENTION

The aim of this invention is to provide a forming tube and a relative machine for making filter bags for infusion products of tetrahedral shape, which is able to overcome the drawbacks of the prior art.

More specifically, the aim of this invention is to provide a forming tube and a machine for making filter bags for infusion products of tetrahedral shape, which is capable of making transversal seals of the filter material which are extremely accurate and secure to obtain a high quality filter bag.

A further aim of this invention is to provide a forming tube and a machine for making filter bags for infusion products of tetrahedral shape, which are simple, compact and have a high productivity.

These aims are fully achieved by a forming tube and a machine for forming filter bags for infusion products of tetrahedral shape according to claim 1 and claim 10, respectively.

Advantageous aspects of the invention are covered by the dependent claims 2 to 9 and 11 to 13.

BRIEF DESCRIPTION OF THE DRAWINGS

A preferred embodiment of the invention will now be described with reference to the accompanying drawings, provided by way of example only and in which.

DETAILED DESCRIPTION OF PREFERRED EMBODIMENTS OF THE INVENTION

Figure 1:
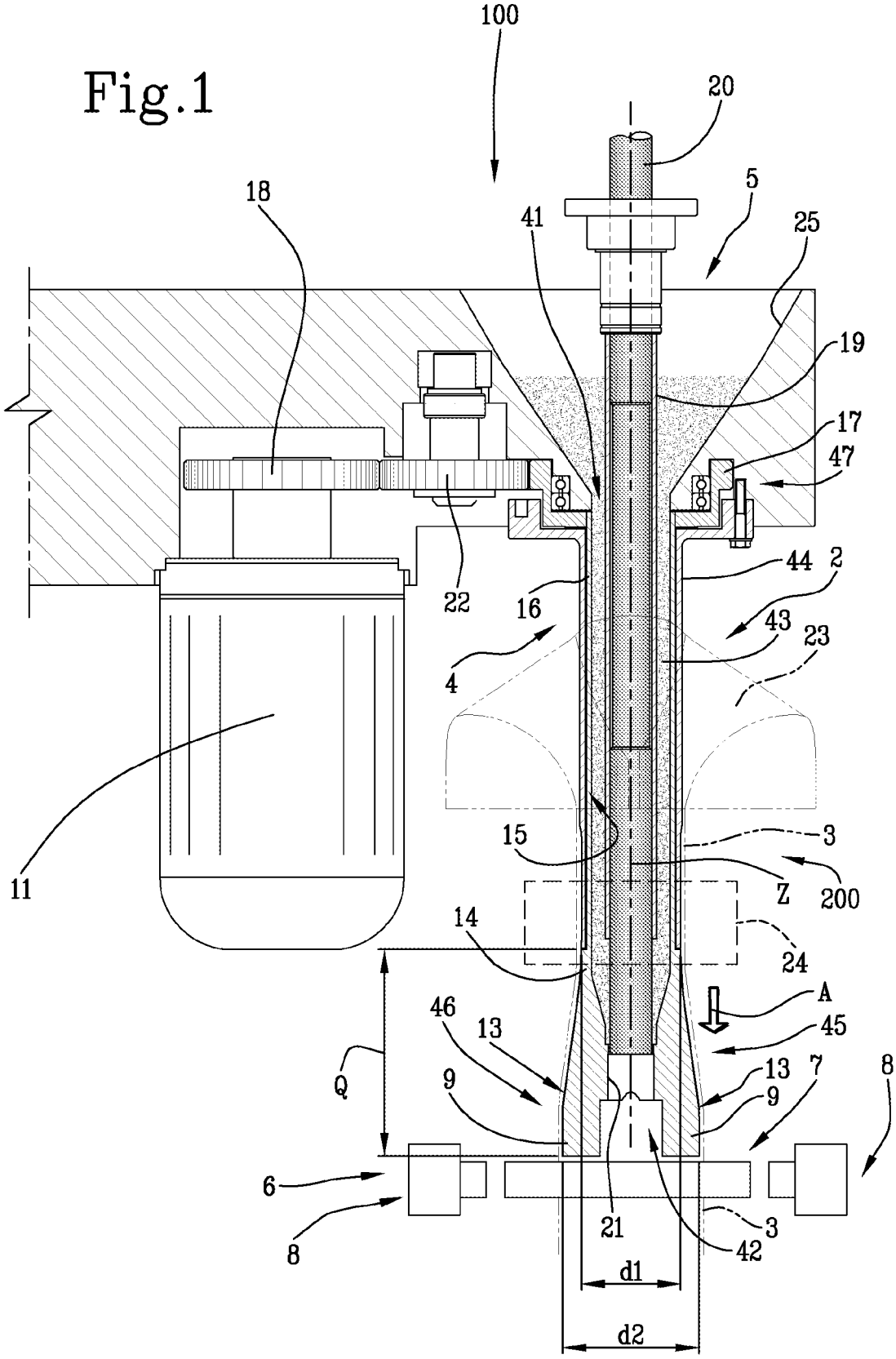
FIG. 1 illustrates a front view, with some parts in cross section and others cut away, of a machine for making filter bags for infusion products comprising a forming tube according to the invention in a first operating position.
Figure 2:
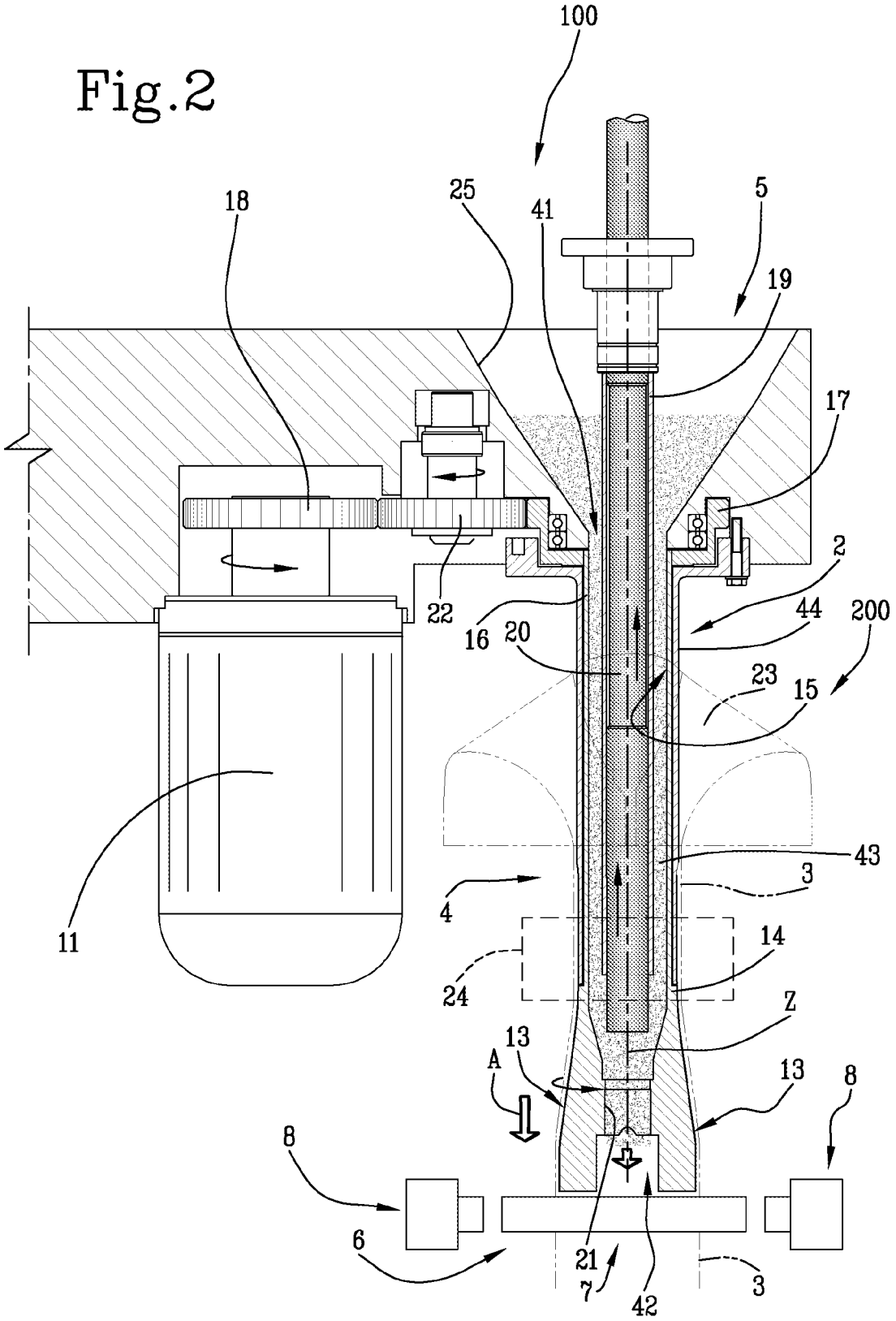
FIG. 2 illustrates a front view, with some parts in cross section and others cut away, of the machine of FIG. 1 in a second operating position.

FIGS. 1 and 2 show a machine 100 for making filter bags 1 of tetrahedral shape for infusion or extraction products (such as tea, coffee, camomile, etc.), comprising a forming tube 200 according to the invention.

The machine 100 has a substantially vertical extension, with operating stations located along a vertical feed direction A, but this does not mean that this invention cannot also be advantageously used on machines with operating stations located along a feed direction A which is not vertical, for example horizontal, or transversal to a vertical direction.

The operating stations of the machine 100 may be moved in step-like fashion or continuously, without thereby limiting the scope of protection of this invention.

The machine 100 comprises a plurality of operating stations including: a forming and joining station 2, to form a continuous strip of filter material and join free longitudinal edges of the strip so as to create a continuous tube 3 of filter material; a feeding station 5 for feeding doses of product inside a continuous tube 3 of filter material; a sealing station 6 designed to make continuous transversal seals on the tube 3 of filter material.

The forming and joining station 2 comprises a forming tube 200 about which is wound the continuous strip of filter material, and an longitudinal sealer 24 element (shown as a dotted line with a block), designed to form a continuous longitudinal seal at the longitudinal free edges of the continuous strip of filter material, so as to form the continuous tube 3 of filter material.

Advantageously, the forming and joining station 2 also comprises a folding device, or tie, 23 comprising at least one folding wall for folding the continuous strip of filter material, unwound from a reel (not illustrated), so as to change from a flat configuration to a tubular configuration.

The forming tube 200 comprises a forming element 4, which is elongate and hollow, which defines a longitudinal axis Z.

The forming element 4 is advantageously associated with the folding device 23.

The continuous tube 3 of filter material which is wound around the forming element 4 is fed along the feed direction A parallel to the longitudinal axis Z, with continuous motion or, alternatively, with intermittent motion. For this purpose, the machine 100 comprises pulling means, advantageously rollers or grippers, located downstream of, or at, the forming tube 200 and not illustrated here for reasons of simplicity, for pulling with continuous motion, or with intermittent motion, the continuous tube 3 of filter material.

The forming tube 4 comprises a first opening 41 through which the product enters in the forming element 4, a second opening 42 through which the product leaves from the forming element 4 to be dosed inside a filter bag 1 being formed, and an inner through cavity 43 which connects the first opening 41 to the second opening 42 and inside of which flows the infusion product The forming element 4 also comprises a main body 44 which is substantially tubular which comprises the first end opening 41 and a forming end 45 which comprises the second opening 42 and designed to connect to the main body 44.

The forming end 45 comprises a connecting portion 14, designed to connect the forming end 45 to the main body 44 and having a first maximum transversal dimension d1, and a forming portion 46 having a second maximum transversal dimension d2, greater than the first maximum transversal dimension d1.

The forming end 45, in particular the forming portion 46, is rotatable relative to the main body 44 about the longitudinal axis Z.

The forming and joining station 2 comprises a drive device 11 designed to rotate the forming end 45, in particular the forming portion 46, relative to the main body 44 about the longitudinal axis Z.

Advantageously, the forming end 45 has a tapered shape along the longitudinal axis Z relative to a first direction and a flared shape along the same longitudinal axis Z relative to a second direction perpendicular to the first direction.

Advantageously, the forming end 45 has a transversal cross section circular relative to a plane transversal to the longitudinal axis Z at the connecting portion 14 and an elongate cross section, advantageously substantially slot-like, transversal relative to a plane transversal to the longitudinal axis Z at the forming portion 46.

The forming end 45 may advantageously comprise two forming projections 9 connected to opposite end portions of the forming portion 46.

The forming end 45, and in particular the forming portion 46 and forming protuberances 9 if present, is configured for keeping in tension, in a predetermined shape, the continuous tube 3 of filter material. In use, therefore, the forming end 45 is positioned inside the continuous tube 3 of filter material, upstream of the sealing station 6.

Advantageously, the forming element 4 comprises a hollow cylindrical body 16. Advantageously, the hollow cylindrical body 16 is positioned inside the main body 44.

The hollow cylindrical body 16 is connected at a first end to the forming end 45, in particular to the connecting portion 14.

Advantageously, the forming tube 200 also comprises a transmission device 47, connected to a second end, opposite the first end along the longitudinal axis Z, of the hollow cylindrical body 16.

The transmission device 47 is designed to be coupled with a drive device 11, to rotate the forming portion 46 about the longitudinal axis Z.

Advantageously, the transmission device 47 comprises a gear wheel 17.

According to the preferred embodiment illustrated in FIGS. 1 and 2, a pinion 18 is keyed directly to the drive device 11 and is connected, by an idle wheel 22, to the gear wheel 17.

In use, therefore, the transmission device 47, the hollow cylindrical body 16, and the forming end 45 rotate relative to the main body 44.

Advantageously, the hollow cylindrical body 16 and the forming end are made in a single body. In other words, the hollow cylindrical body 16, the connecting portion 14 and the forming portion 46 are made in a single piece.

In short, the drive device 11 is designed to actuate the forming end 45 rotating about the longitudinal axis Z in a synchronised fashion with the sealing station 6.

The sealing station 6 is positioned downstream of the forming tube 200, in particular of the forming end 45, and comprises a first pair 7 and a second pair 8 of sealing units, positioned on the same plane. In the preferred embodiment illustrated, the pairs 7, 8 of sealing units are arranged at an equal distance Q from the main body 44.

Each pair 7, 8 of sealing units comprises a first and a second sealing unit, positioned on the side opposite the continuous tube 3 of filter material.

The pairs 7, 8 of sealing units are configured to obtain, in a synchronised fashion, a first and a second transversal seal on the continuous tube 3 of filter material oriented differently to each other by a right angle on a plane perpendicular to the longitudinal axis Z, in such a way as to divide, at regular intervals along the feed direction A, pieces of continuous tube 3 of filter material which define individual filter bags 1 of tetrahedral shape joined to each other.

Cutting means (for example blade-like devices, or devices of the punch/die type, of known type and therefore not illustrated) are positioned downstream of the sealing station 6 for separating individual filter bags 1.

In an alternative embodiment not illustrated, cutting means (for example blade-like devices, or devices of the punch/die type) can be integrated in the sealing units, so as to seal and simultaneously separate a filter bag 1 formed from a next filter bag 1 being formed.

In short, each transversal seal made in the sealing station 6 defines a head of a finished filter bag 1 and a bottom end of a next filter bag 1 being formed.

Preferably, the forming end 45 (see FIGS. 4 and 5) has a first pair of faces 13, or surfaces, in contact opposite each other, extending, starting from the connecting portion 14, inclined and away, at least partly, from the longitudinal axis Z of the forming element 4. In use, the second pair 13 of opposite contact faces is designed to come into contact with and tension the filter material.

Preferably, the forming end 45 has a second pair of faces 12, or surfaces, in contact opposite each other, connected to the first pair of surfaces 13, extending, starting from the connecting portion 14 inclined and towards the longitudinal axis Z of the forming element 4.

In short, the forming end 45 and in particular the forming portion 46, is able to tension and keeping taut transversely the continuous tube 3 of filter material.

It should be noted that the continuous tube 3 of filter material has, at the main body 44, a circular transversal cross section with diameter substantially equal to d1, that is to say, substantially equal to the first maximum transversal dimension d1 of the connecting portion 14 of the forming end 45.

As a result of the shape of the forming end 45, tapered along the longitudinal axis Z relative to a first direction and flared along the same longitudinal axis Z relative to a second direction perpendicular to the first direction, the continuous tube 3 of filter material has, immediately downstream of the forming tube 200, an elongate transversal cross section, for example slot-like, which defines a main direction of transversal extension Y of the continuous tube 3 of filter material, perpendicular to the longitudinal axis Z of the forming element 4. Basically, the continuous tube 3 of filter material has, immediately downstream of the forming tube 200, a transversal cross section with maximum dimension equal to d2, that is to say, equal to the second maximum transversal dimension d2 of the forming portion 46 of the forming end 45.

In other words, the forming end 45 modifies the shape, in transversal cross section relative to, and along, the longitudinal axis Z, of the continuous tube 3 of filter material, from circular to elongate, for example slot-like, and simultaneously increases a maximum transversal dimension of the continuous tube 3 of filter material, from d1 to d2.

The forming end 45, rotating in a stepwise fashion about the longitudinal axis Z, rotates, consequently in a step-like fashion, the main direction of transversal extension Y of the continuous tube 3 of filter material in a plane perpendicular to the longitudinal axis Z of the forming element 4.

As a result of the step-like rotation of the forming end 45, the main direction of transversal extension Y rotates in a step-like fashion on a plane perpendicular to the longitudinal axis Z of the forming element 4.

It should be noted that, as a result of the rotation of the forming end 45, the continuous tube 3 of filter material does not rotate about the longitudinal axis Z, rather it is the main direction of transversal extension Y of the continuous tube 3 of filter material which rotates. In other words, the forming end 45 slides on the filter material, in particular on an inner surface of the continuous tube 3 of filter material.

The sealing station 6 operates in a synchronised fashion with the forming end 45.

The sealing station 6 comprises movement means (not illustrated) for moving each pair 7, 8 of sealing units between a non-active position, wherein the sealing units are moved away from the continuous tube 3 of filter material, and an active position, wherein the sealing units are in contact with a portion of the continuous tube 3 of filter material and create a transversal seal.

In detail, the forming end 45 is rotated so as to place the main direction of transversal extension Y of the continuous tube 3 of filter material parallel to the pair (7 or 8) of sealing units which must carry out the transversal sealing.

Figure 4:
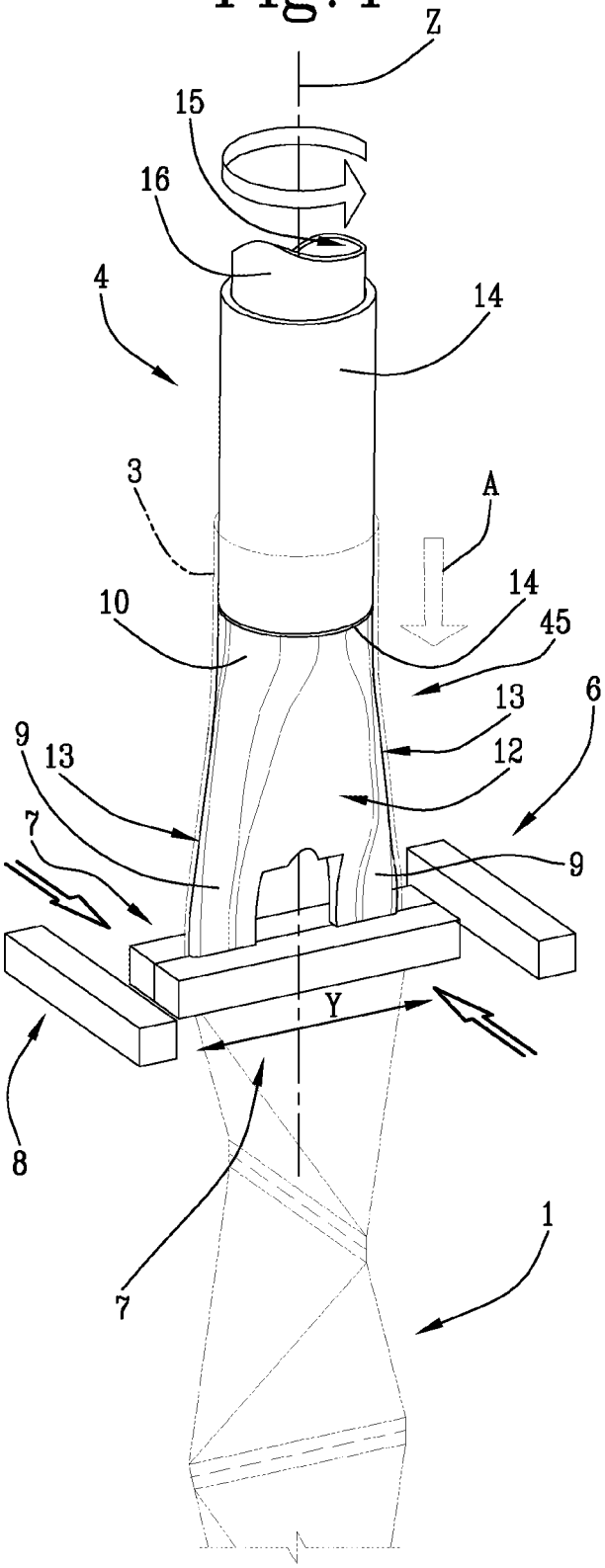
FIGS. 4 and 5 are perspective views, with some parts cut away, of a detail of the forming tube according to the invention and two pairs of sealing units in two different operating steps.
Figure 5:
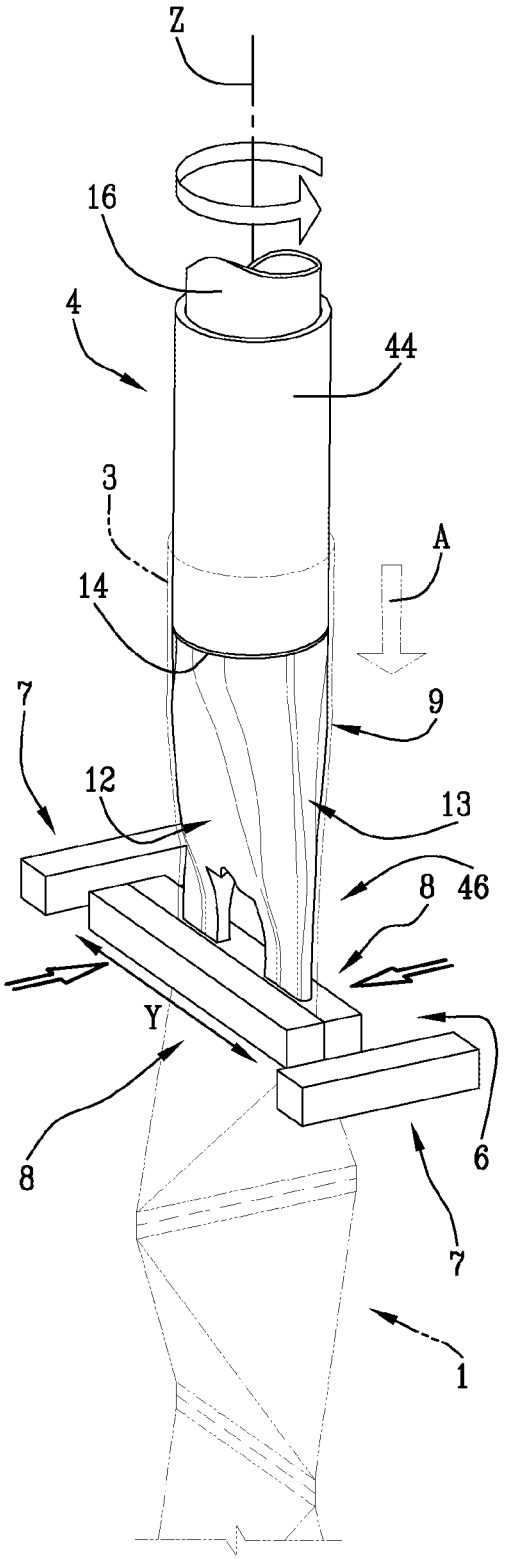

Once the first transversal seal has been made, for example by the first pair 7 of sealing units (as illustrated in FIG. 4), the continuous tube 3 of filter material is moved, in a step-like or continuous fashion, along the feed direction A, and the forming end 45 is rotated by 90°, to rotate by 90° the main direction of transversal extension Y of the continuous tube 3 of filter material, which is parallel to the second pair of sealing units 8, which can correctly make the second transversal seal, rotated by 90° on a plane perpendicular to the longitudinal axis Z relative to the first transversal seal (as illustrated in FIG. 5).

In use, therefore, the opposite surfaces of contact of the second pair 12 of the forming end 45 are always facing each other and parallel with the sealing units of the pair (7 or 8) which is making the transversal seal, or in other words, that is in the active position.

Therefore, thanks to the possibility to rotate, the forming end 45 is always correctly positioned relative to the pairs 7 and 8 of sealing units, and the continuous tube 3 of filter material is correctly tensioned and oriented relative to the same pairs 7 and 8 of sealing units.

Once the transversal seal has been formed, the sealing units of the pair (7 or 8) move away from each other, to move from the active position to the non-active position, allow the forming end 45 to rotate and the continuous tube 3 of filter material to feed along the feed direction A.

The feeding station 5 is configured for feeding doses of product inside the filter bag 1 being formed.

Figure 3:
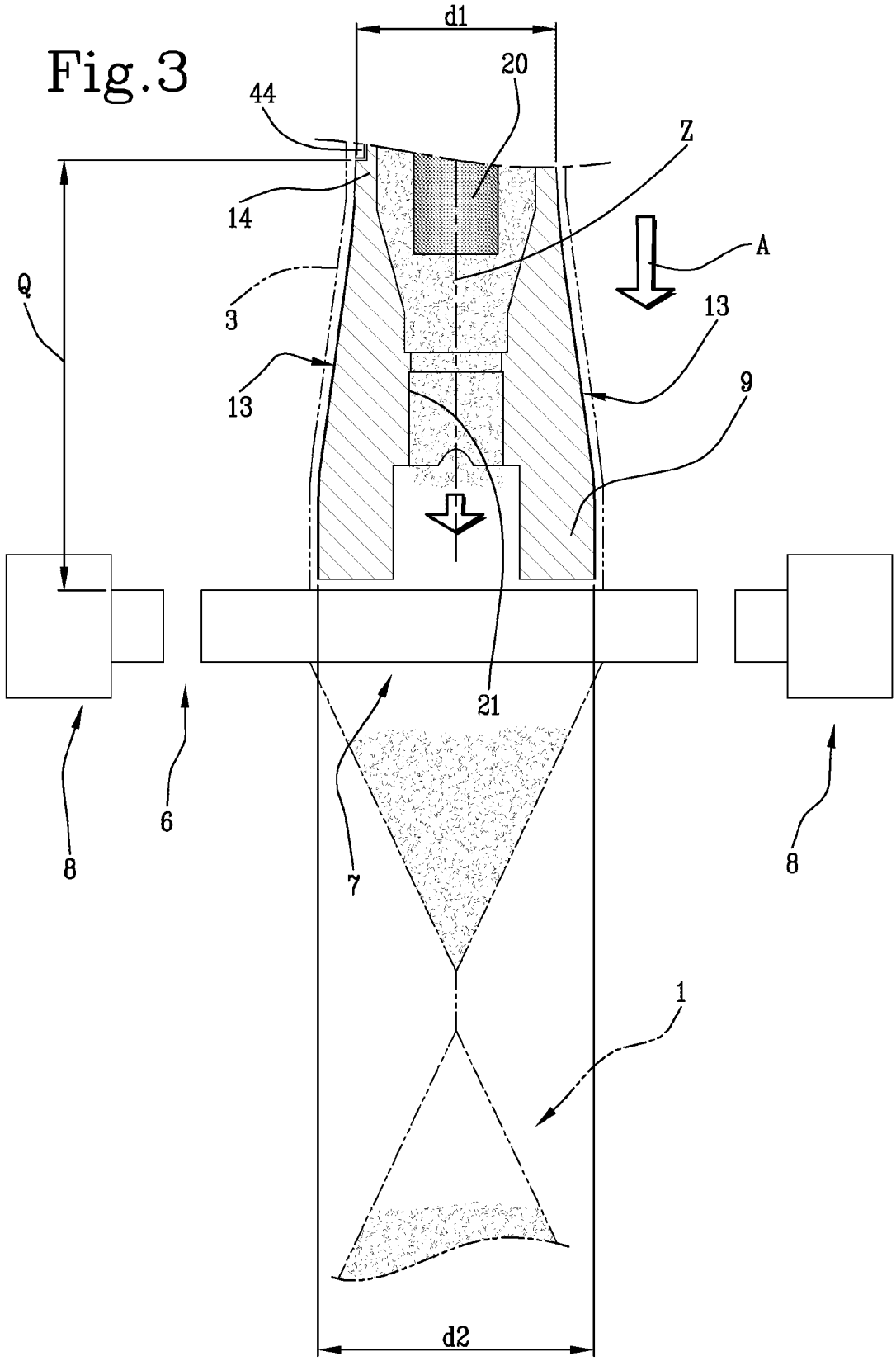
FIG. 3 is an enlarged detail of FIG. 2.

In detail, the feed station 5 comprises a feed hopper 25, designed to contain the product and connected to the forming tube 200 at the first opening 41, and a dosing piston 20, linearly movable inside the inner through cavity 43 of the forming element 4 along the longitudinal axis Z, between a first operating position (FIGS. 2 and 3) wherein it leaves open the second opening 42 and allows the product to escape from the forming element 4 and fall inside a filter bag 1 being formed, and a second operating position (FIG. 1) wherein it closes the second opening 42, not allowing the product to escape from the forming element 4.

Advantageously, the feed station 5 further comprises a tubular element 19, positioned inside the through inner cavity 43 of the forming element 4, the dosing piston 20 being positioned and movable inside the tubular element 19.

The tubular element 19 is positioned coaxially to the main body 44 of the forming element 4. The tubular element has an outer cylindrical surface which defines with an inner surface 15 of the hollow cylindrical body 16 of the forming end 45 a toroidal space inside of which the infusion product flows.

The dosing piston 20 is driven in a synchronised fashion with the sealing station 6, to feed a dose of product inside a filter bag 1 being formed, once the sealing station 6 has made on the continuous tube 3 of filter material a first transversal seal, which defines the bottom of the filter bag 1 being formed.

In other words, therefore, the dosing piston 20 doses a dose of product inside the filter bag 1, once the bottom has been made.

Advantageously, the forming end 45 comprises a seat 21, which connects the second opening 42 with the through inner cavity 43 of the forming element 4. The seat 21 is engaged by the dosing piston 20 in the second operating position, so as to prevent passage of product through the second opening 42.

A forming tube 200 as described achieves the preset aims, thanks to the presence of a forming end 45 rotating about an axis of rotation parallel to the feed direction A of the continuous tube 3 of filter material.

The forming end 45 therefore allows the continuous tube 3 of filter material to be kept suitably tensioned transversely, to prepare the continuous tube 3 of filter material in a configuration (a slot-like transversal cross section) suitable to perform the transversal seals, and to rotate the main direction of transversal extension Y of the continuous tube 3 of filter material for conveniently positioning the continuous tube 3 of filter material in front of the pairs 7, 8 of sealing units of the sealing station 6 which must make the transversal seals.

The invention claimed is:

1. A machine for forming filter bags of tetrahedral shape containing infusion product, the machine comprising:

a forming and joining station to form a continuous strip of filter material and create a continuous tube of filter material, the forming and joining station comprising:

i) a forming tube configured to be wound by the continuous strip of filter material moving along a feed direction, the forming tube comprising a hollow forming element extended along a longitudinal axis parallel to the feed direction and having a first opening and a second opening communicating by means of an inner through cavity through which the infusion product entering from the first opening flows to exit from the second opening so as to be dosed inside a filter bag in formation, the forming element comprising a main cylindrical body and a forming member, the forming member having a connecting portion proximal to the main cylindrical body and a forming portion distal from the main cylindrical body, the forming portion being provided with the second opening and having a maximum transversal dimension greater than the maximum transversal dimension of the connecting portion;

ii) a longitudinal sealing element configured to form a continuous longitudinal seal at a free longitudinal edges of the continuous strip of filter material, in order to form the continuous tube of filter material;

a feeding station for feeding the infusion product inside the inner through cavity;

a sealing station comprising transversal sealing elements configured to make transversal seals on the continuous tube of filter material, the transversal seals being alternately rotated by 90° on a plane perpendicular to the longitudinal axis, wherein the forming member is rotatable joined to the main cylindrical body to rotate about the longitudinal axis, and wherein the connecting portion of the forming member has a transversal cross section which is circular relative to a plane transversal to the longitudinal axis and the forming portion of the forming member has a transversal cross section which is elongate relative to a plane transversal to the longitudinal axis.

2. The machine according to claim 1, wherein the forming member comprises a hollow cylindrical body provided with the inner through cavity.

3. The machine according to claim 2, wherein the hollow cylindrical body of the forming member is positioned inside the main cylindrical body.

4. The machine according to claim 3, wherein the hollow cylindrical body of the forming member is in contact with an internal surface of the main cylindrical body.

5. The machine according to claim 2, wherein the connecting portion is between the hollow cylindrical body and the forming portion.

6. The machine according to claim 2, wherein the hollow cylindrical body, the connecting portion and the forming portion are made in a single piece.

7. The machine according to claim 1, wherein the forming portion of the forming member has a tapered shape along the longitudinal axis relative to a first direction and a flared shape along the longitudinal axis relative to a second direction perpendicular to the first direction.

8. The machine according to claim 1, comprising a transmission device connected to the forming member and coupled with a drive device to rotate the forming member about the longitudinal axis.

9. The machine according to claim 1, wherein the feeding station comprises:

a feed hopper configured to contain the infusion products and connected to the forming tube at the first opening; and a dosing piston, linearly movable inside the through inner cavity and along the longitudinal axis, between a first operating position wherein it leaves open the second opening and allows the infusion product to exit from the forming element and fall inside a filter bag in formation, and a second operating position wherein it closes the second opening, blocking the infusion product within the through inner cavity.

10. The machine according to claim 9, comprising a tubular element, positioned inside the through inner cavity of the forming element, the dosing piston being positioned and movable inside the tubular element.

11. The machine according to claim 9, wherein the tubular element has an outer cylindrical surface distanced from an inner surface of a hollow cylindrical body of the forming member, the space between said outer cylindrical surface of the tubular element and said inner surface of the hollow cylindrical body forming a passage for the infusion product when the infusion product flows from the first opening to the second opening.

12. The machine according to claim 1, wherein the forming and joining station further comprises a folding device comprising at least one folding wall for folding the continuous strip of filter material, so as to modify from a flat configuration to a tubular configuration.

* * * * *